US009576588B2

(12) United States Patent
Goldstein et al.

(10) Patent No.: US 9,576,588 B2
(45) Date of Patent: Feb. 21, 2017

(54) CLOSE-TALK DETECTOR FOR PERSONAL LISTENING DEVICE WITH ADAPTIVE ACTIVE NOISE CONTROL

(71) Applicant: Apple Inc., Cupertino, CA (US)

(72) Inventors: Andre L. Goldstein, San Jose, CA (US); Esge B. Andersen, Campbell, CA (US)

(73) Assignee: Apple Inc., Cupertino, CA (US)

( * ) Notice: Subject to any disclaimer, the term of this patent is extended or adjusted under 35 U.S.C. 154(b) by 221 days.

(21) Appl. No.: 14/338,170

(22) Filed: Jul. 22, 2014

(65) Prior Publication Data

US 2015/0228292 A1 Aug. 13, 2015

Related U.S. Application Data

(60) Provisional application No. 61/937,919, filed on Feb. 10, 2014.

(51) Int. Cl.
*G10L 21/0208* (2013.01)
*G10K 11/178* (2006.01)

(52) U.S. Cl.
CPC ..... *G10L 21/0208* (2013.01); *G10K 11/178* (2013.01); *G10K 2210/1081* (2013.01)

(58) Field of Classification Search
CPC ..... G10L 21/0208; G10K 11/178; G10K 2210/1081; G10K 11/16; G10K 11/1784; H04R 3/005; H04R 2410/05; H04R 2499/11
USPC ..... 381/71.1, 71.2, 71.6, 71.8, 71.11
See application file for complete search history.

(56) References Cited

U.S. PATENT DOCUMENTS

| | | | | |
|---|---|---|---|---|
| 8,515,089 | B2 | 8/2013 | Nicholson | |
| 9,094,744 | B1 * | 7/2015 | Lu | H04R 3/005 |
| 2007/0233479 | A1 * | 10/2007 | Burnett | G10L 25/93 704/233 |
| 2009/0252351 | A1 | 10/2009 | Rosener | |
| 2012/0140943 | A1 * | 6/2012 | Hendrix | G10K 11/1782 381/71.11 |
| 2012/0316872 | A1 | 12/2012 | Stoltz et al. | |

* cited by examiner

*Primary Examiner* — David Ton
(74) *Attorney, Agent, or Firm* — Blakely, Sokoloff, Taylor & Zafman LLP

(57) ABSTRACT

A close-talk detector detects a near-end user's speech signal, while an adaptive ANC process is running, and in response helps prevent the filter coefficients of an adaptive filter of the ANC process from being corrupted, thereby reducing the risk of the adaptive filters diverge. Upon detecting speech using a vibration sensor signal and one or more microphone signals, the detector asserts a signal that slows down, or even freezes or halts, the adaptation of the adaptive filter. The signal may be de-asserted when no more speech is being detected, thereby allowing the adaptive ANC process to resume its normal rate adaptation of the filter. The detector may continuously operate in this manner during the call, as the user talks and then pauses and then resumes talking. Other embodiments are also described.

25 Claims, 2 Drawing Sheets

CLOSE-TALK DETECTOR FOR PERSONAL LISTENING DEVICE WITH ADAPTIVE ACTIVE NOISE CONTROL

This non-provisional application claims the benefit of the earlier filing date of provisional application No. 61/937,919 filed Feb. 10, 2014.

An embodiment of the invention relates to personal listening audio devices such as earphones and telephone handsets, and in particular the use of acoustic noise cancellation or active noise control (ANC) to improve the user's listening experience by attenuating external or ambient background noise. Other embodiments are also described.

BACKGROUND

It is often desirable to use personal listening devices when listening to music and other audio material, or when participating in a telephone call, in order to not disturb others that are nearby. When a compact profile is desired, users often elect to use in-ear earphones or headphones, sometimes referred to as earbuds. To provide a form of passive barrier against ambient noise, earphones are often designed to form some level of acoustic seal with the ear of the wearer. In the case of earbuds, silicone or foam tips of different sizes can be used to improve the fit within the ear and also improve passive noise isolation.

With certain types of earphones, such as loose fitting earbuds, as well telephone handsets, there is significant acoustic leakage between the atmosphere or ambient environment and the user's ear canal, past the external surfaces of the earphone or handset housing and into the ear. This acoustic leakage could be due to the loose fitting nature of the earbud housing, which promotes comfort for the user. However, the additional acoustic leakage does not allow for enough passive attenuation of the ambient noise at the user's eardrum. The resulting poor passive acoustic attenuation can lead to lower quality user experience of the desired user audio content, either due to low signal-to-noise ratio or speech intelligibility especially in environments with high ambient or background noise levels. In such a case, an ANC mechanism may be effective to reduce the background noise and thereby improve the user's experience.

ANC is a technique that aims to "cancel" unwanted noise, by introducing an additional, electronically controlled sound field referred to as anti-noise. The anti-noise is electronically designed so as to have the proper pressure amplitude and phase that destructively interferes with the unwanted noise or disturbance. An error sensor (typically an acoustic error microphone) is provided in the earphone housing to detect the so-called residual or error noise. The output of the error microphone is used by a control system to adjust how the anti-noise is produced, so as to reduce the ambient noise that is being heard by the wearer of the earphone. In some cases, there is also a reference microphone that is positioned some distance away from the error microphone, and whose signal is used by certain ANC algorithms. The ANC controller operates while the user is, for example, listening to a digital music file that is stored in a local audio source device, or while the user is conducting a conversation with a far-end user of a communications network in an audio or video phone call, or during another audio application that may be running in the audio source device. The ANC controller implements digital signal processing operations upon the microphone signals so as to produce an anti-noise signal, where the anti-noise signal is then converted into sound by the speaker driver system.

SUMMARY

The implementation of an adaptive ANC system can benefit from a mechanism that automatically detects near-end speech (or close-talk), which is the situation in which the user of the personal listening device is talking, for example during a phone call. Due to the proximity of the various microphones (used by the ANC system in a personal listening device) to the user's mouth, the near-end speech can be picked up by for example both the reference and error microphones. This speech signal, which appears in the outputs of the reference and error microphones, has been found to act as a disturbance to the adaptive filter algorithms running in the ANC system. The disturbance can cause the divergence of the algorithms which are adapting one or more adaptive filters, namely a control filter (e.g., W(z), or G(z)) and in some cases a so-called S_hat(z) filter. A close-talk detector may automatically detect such a speech signal and in response help prevent the digital filter control signals, which serve to adjust their adaptive filters, from being corrupted, thereby reducing the risk of the adaptive filters diverging. For example, upon detecting speech using a signal from a vibration sensor that is inside the personal listening device, in combination with one or more of the microphone signals, the detector may assert a signal that slows down, or even freezes or halts, the adaptation of one or more of the adaptive filters in the ANC system. The signal may be de-asserted when no close-talk is being detected, thereby allowing the adaptive ANC processes to resume their normal updating of their adaptive filters. The close-talk detector may continuously operate in this manner during for example a phone call, as the near-end user talks and then pauses and then resumes talking to a far-end user.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness, a single figure is sometimes used to illustrate multiple embodiments of the invention; in that case, it may be that some of the elements shown in the figure are not necessary to certain embodiments.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
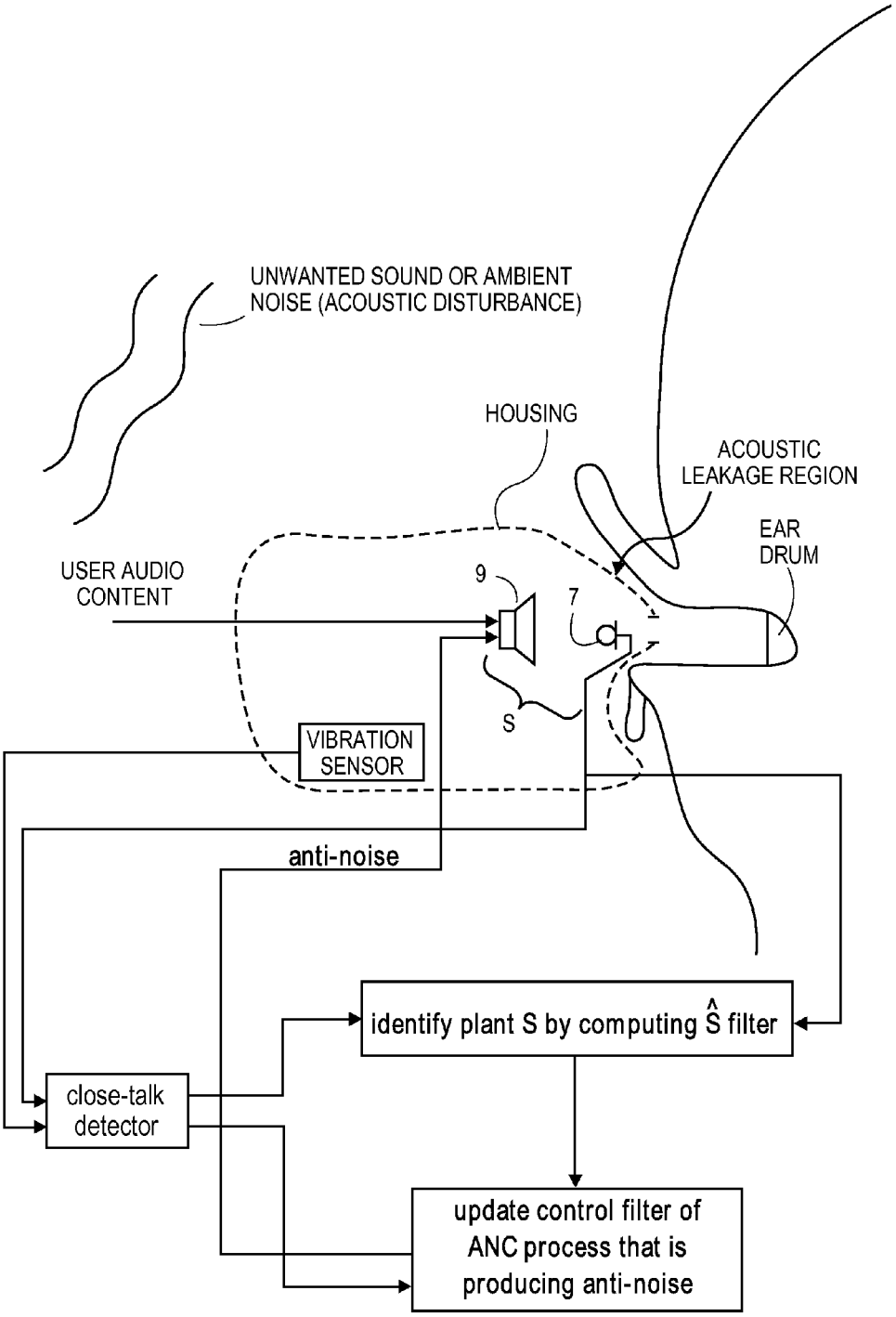
FIG. 1 is a block diagram of part of a consumer electronics personal listening device in which an embodiment of the invention can be implemented.

FIG. 1 is a block diagram of part of a consumer electronics personal listening device having an ANC system and in which an embodiment of the invention can be implemented. The personal listening device depicted here has a housing in which a speaker driver system 9 is contained in addition to an error microphone 7. The housing, also referred to as a speaker housing, is to be held against or inside a user's ear as shown, and the speaker driver system 9 integrated therein. The speaker driver system 9 is to convert an audio signal, which may include user audio content (or perhaps an ANC system training audio signal) and an anti-noise signal, into sound. It should be noted that in some cases, the speaker driver system 9 may have multiple drivers, one or more of which could be dedicated to convert the anti-noise signal, though in most instances there is at least one driver that receives a mix of both the user audio content and the anti-noise within its input audio signal. The sound produced by the driver system 9 will be heard by the user in addition to unwanted sound or ambient noise (also referred to as acoustic disturbance) that manages to leak past the speaker housing and into the user's ear canal. The housing may be, for example, that of a wired or wireless headset or earphone, a loose fitting ear bud housing, a telephone receiver portion of the housing of a mobile phone handset, a supra-oral earphone housing, or other type of personal listening device housing in which there is an earpiece speaker housing that is held against or at least partially inside the user's ear while an audio process is running in the device. In the case of an earphone, the user audio content or ANC training audio sweep signal may be delivered through a wired or wireless connection (not shown) from a separate audio source device such as a nearby smartphone, a tablet computer, or a laptop computer. In all of these instances, there may be a variable acoustic leakage region where the disturbance can leak past the speaker housing and into the ear canal. Although not shown in FIG. 1, in some instances the housing may also include a reference microphone which would be positioned typically at an opposite end or opposite face of the housing as the error microphone 7 and the speaker driver system 9, in order to better pick up the unwanted acoustic disturbance prior to its passing into the ear canal.

In addition, the housing contains a vibration sensor that may be rigidly mounted to the housing so as to perform non-acoustic pick up of the user's voice, such as through bone conduction. Examples of the vibration sensor include a multi-axis accelerometer, a gyroscopic sensor, and an inertial sensor that can provide output signals (e.g., digital signals) representing vibration pickup due to the user's talking. A close-talk detector uses the vibration sensor and one or more microphone signals, which microphone signals are also being used by an ANC controller, to control different aspects of ANC controller. FIG. 1 shows two such aspects of such a controller, namely a plant S identification process and an ANC adaptive control filter update process, where the latter relies on the former, which are described below. The ANC controller is operating while the speaker housing is up against the user's ear as shown, and the user is, for example, listening to a digital music file that is stored in a local audio source device, or conducting a conversation with a far-end user of a communications network in an audio or video phone call.

Signals from the error microphone 7 and optionally one or more reference microphones are produced in or converted into digital form, for use by the ANC controller. The latter performs digital signal processing operations upon the microphone signals to produce an anti-noise signal, where the anti-noise signal is then converted into sound by the speaker driver system 9 (as shown in FIG. 1). The control filter is a programmable digital filter that is to process a signal which has been derived from the output of one or more microphones (at least the error microphone 7), in order to produce an anti-noise signal that has the required amplitude and phase characteristics for effective cancellation of the disturbance (which is the ambient noise that has leaked into the user's ear canal as shown in FIG. 1). In many instances, the control filter is configured or updated, as it is here, in that its digital filter coefficients are set based on the assumption that the electroacoustic response between the speaker driver system 9 and the error microphone 7, when the housing has been placed in or against the ear, can be quantified. This electroacoustic response is often referred to as the "plant" or the "secondary" acoustic path transfer function, S(z), or simply S. This is in view of a "primary" acoustic path, P(z), that is the path taken by the disturbance in arriving at the user's eardrum.

In a feedback type of ANC system, a signal representing the disturbance as picked up by the error microphone 7 is fed to the control filter, which in turn produces the anti-noise. The control filter in that case is sometimes designated G(z). The control filter G(z) may be adapted, or adaptively controlled or varied, so that its output causes a sound field referred to as anti-noise to be produced that destructively interferes with the disturbance (which has arrived at the eardrum through the primary acoustic path. In an ANC system that has a feed forward algorithm, the control filter is sometimes designated W(z). An input signal to the control filter W(z) is derived from the output of a reference microphone (not shown in FIG. 1 but see FIG. 2 described below), which is located so as to pick up the disturbance before the disturbance has completed its travel through the primary acoustic path. In a hybrid approach, elements of the feed forward and feedback topologies may be combined, where the control filter mechanism produces an anti-noise signal that may be based on input signals which are derived from both an output of the reference microphone and an output of the error microphone 7, and where the control filter mechanism may continue to be adapted using a signal from the error microphone 7.

In some cases, the frequency response of the overall sound producing system, which includes the electro-acoustic response of the speaker driver system 9 and the physical or acoustic features of the user's ear up to the eardrum, can vary substantially during normal end-user operation, as well as across different users. Thus, it is desirable for improved performance to implement a digital ANC system that has a processor which is programmed with an adaptive filter algorithm, such as the filtered-x least means square algorithm (FXLMS), which programmed processor can be viewed as a means for adapting the programmable digital filter (referred to as the control filter). In such an algorithm, the residual error (as picked up by the error microphone 7)

is continually being used to monitor the performance of the ANC system, aiming to reduce the error (and hence the ambient noise that is being heard by the user of the earphone or telephone handset). The reference microphone may also used, to help pick up the ambient noise or disturbance. In such algorithms, adaptive identification of the secondary path S(z) may also be required. Thus, in such cases, there may be two adaptive filter algorithms operating simultaneously for each channel, namely one that adapts the control filter W(z) or G(z) to produce the anti-noise, and another that adapts an estimate of the secondary path, namely a filter S_hat(z). This process takes place while user audio content, e.g. a downlink communications signal, a media playback signal from a locally stored media file or a remotely stored media file that is being streamed, or a training audio signal, is being converted into sound by the speaker driver system 9.

As mentioned above, when an adaptive ANC process operating upon a personal listening device being an earphone or a phone handset, the user speech is often picked-up by the error microphone 7 (and by, if present, a reference microphone). This speech signal disturbs the adaptation of the filters W(z) and SA(z), possibly causing one or both of these adaptive filters to diverge from a solution, or become unstable. In order to prevent the divergence of these adaptive filters during user speech, the close-talk detector (see FIG. 1) digitally processes the vibration sensor signal and one or more of the microphone signals, and detects or declares a close-talk event or close-talk state in the controller, that coincides with the user talking, in response to the close talk event being declared or detected, the controller slows down or freezes the filter adaptation.

In one embodiment, the close talk detector performs a digital signal processing-based cross-correlation function between the vibration sensor signal and at least one or both of the error microphone 7 and reference microphone signals, to thereby create a detection statistic or detection metric. This statistic is then evaluated for declaring a close-talk event. For example, the detection statistic can be computed using the L2 norm of the cross-correlation vector between the vibration sensor and microphone signals. This may be performed using either time domain vectors or frequency bin vectors. The L2 norm of the cross-correlation vector may be normalized by dividing it by a computed energy of the vibration sensor and microphone signals, for the time window (or the frequency bins) for which the cross-correlation is computed. The detection statistic is then compared to a fixed or variable preset threshold, and close-talk is declared if the statistic is greater than the threshold.

In one embodiment, when an initial close-talk event is declared, the declaration may then be held for a predefined minimum period of time (hold interval) during which the adaptation of the filters SA(z) and/or W(z) is slowed down or frozen, regardless of having detected during the hold interval that user speech has stopped. When the hold interval then expires, and a subsequent instance of computing the detection statistic is found to be lower than a fixed or variable preset threshold (which may be the same or different than the threshold that was used for declaring the close-talk event), then the close talk event is declared to be over.

The adaptation may be slowed down by for example reducing the step size parameter of a gradient descent-type adaptive filter algorithm. This may be done while maintaining the same sampling rate for the digital microphone signal, and perhaps also for the vibration sensor signal. Alternatively, or in addition, the update interval for actually updating the coefficients of the adaptive filter can be changed, for example from 20 microseconds to several milliseconds. Of course, the adaptation may be frozen in that the coefficients of the digital adaptive filters are kept essentially unchanged upon the occurrence of the close talk event and then are only allowed to be updated once the close talk event is determined to be over. In one embodiment, the adaptive filter algorithm may be allowed to continue to run during a holding interval, immediately following the declaration of a close talk event, i.e. the controller continues to produce new coefficient lists, though the adaptive filter is not actually being updated with the new coefficients.

Figure 2:
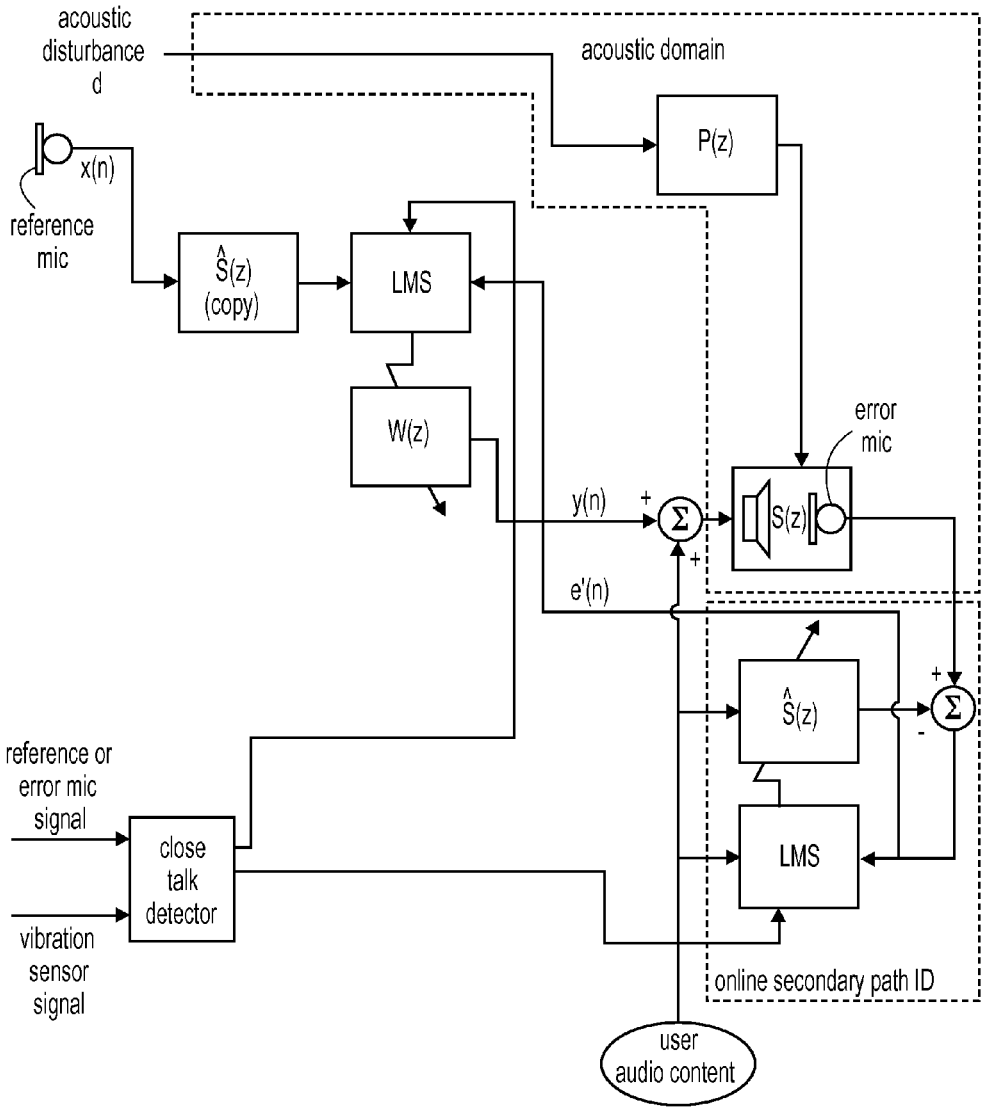
FIG. 2 is a block diagram of a method and personal listening device in which close talk detection is used to improve an example adaptive ANC system.

Referring now to FIG. 2, this figure shows an ANC system that uses a filtered-x LMS feed forward adaptive algorithm, for computing its control filter W(z). An online secondary path identification block adapts the coefficients of the filter Ŝ(z) in an attempt to match the response of the control plant S. The identification can be performed while the anti-noise signal is being combined with user audio content from a media player or telephony device, or with a predefined audio identification noise or audio sweep signal (not shown). The control filter W(z) is adapted according to the filtered-x LMS algorithm that adapts using the reference signal x(n) as filtered by a copy of S_hat(z), and the residual error signal e'(n). The disturbance in this case may be any ambient noise, or it may be an electronically controlled disturbance signal (test or training signal) produced by a nearby loudspeaker (not shown).

In the case of a feed forward algorithm such as the one shown in FIG. 2, the anti-noise signal y(n) is generated by filter W(z) and is combined with the user audio content to drive the speaker system 9. In contrast, in a feedback algorithm (not shown), the anti-noise y(n) is generated by a variable filter G(z) whose input is driven by a signal derived from the residual error signal e'(n) (coming from the error microphone 7). In yet another embodiment, namely a hybrid approach, y(n) is produced based on the outputs of both a W(z) filter and a G(z) filter. The close talk detector described here may be used in any one of these adaptive embodiments, to slow down or freeze the adaptation of one or more of the adaptive or variable control filters W(z), G(z). In the example of FIG. 2, the close detector asserts a signal that slow down or freeze the least means squares (LMS) adaptive filter engine that is adapting the W(z) control filter. FIG. 2 also shows the option of the asserted signal (from the close talk detector) being used to slow down or freeze the LMS engine that is adapting the S_hat(z) filter.

The close-talk detector described above may also be designed to detect when the close-talk event should be ended, i.e. a condition where the user of the personal listening device has stopped talking. The same digital signals from the vibration sensor and the one or more microphone signals that were used to detect the close talk condition can also be used here to detect when the user speech pauses. In one embodiment, the same statistic that was used for declaring a close-talk event can be recomputed and compared to a threshold (which may be different than the threshold used for declaring the close-talk event, such as when applying hysteresis in transitioning between declaring a close-talk event and declaring the close-talk is over). Movement of the statistic in the opposite direction in this case (relative to the threshold) means that the detector will signal an end to the close-talk event, where insufficient user speech is being detected (that is, a level which is expected to be insufficient to disturb the normal adaption process for the control filter, and, optionally, the adaption process for the S_hat filter). In one embodiment, while the ANC process is active but is updating its adaptive control filter slowly or has frozen the updating, the ANC controller responds to the ending of a close talk event by speeding up or unfreezing its continuing adaptation of the control filter.

As described above, an embodiment of the invention may be implemented as a machine-readable medium (such as microelectronic memory) having stored thereon instructions, which program one or more data processing components (generically referred to here as a "processor") to perform the digital signal processing operations described above upon the vibration sensor signal and the microphone signals, including conversion from discrete time domain to frequency domain, cross correlation and L2 norm calculations, and comparisons and decision making, for example. In other embodiments, some of these operations might be performed by specific hardware components that contain hardwired logic (e.g., dedicated digital filter blocks). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although some numerical values may have been given above, these are only examples used to illustrate some practical instances; they should be not used to limit the scope of the invention. In addition, other cross correlation techniques for computing the detection statistic may be used. The description here in general is to be regarded as illustrative instead of limiting.

The invention claimed is:

1. A method for active noise control (ANC) in a personal listening device that is at a user's ear, comprising:

performing an adaptive active noise control (ANC) process in a personal listening audio device, wherein the personal listening audio device has an earphone housing or a mobile phone handset housing containing a speaker driver system and that is up against the user's ear, and wherein the ANC process uses an adaptive control filter to produce an anti-noise signal that is fed to the speaker driver system;

computing a statistic using an L2 norm of a cross-correlation vector between a vibration sensor and an acoustic microphone that are integrated in the earphone housing or mobile phone handset housing of the device;

comparing the statistic to a threshold;

declaring a close talk event when the statistic is greater than the threshold; and slowing down or freezing adaptation of the adaptive control filter, in response to the close talk event being declared.

2. The method of claim 1 further comprising holding the declaration of the close talk event for a predefined period of time, even though speech by the user is not being detected during the predefined period of time.

3. The method of claim 2 further comprising declaring that the close talk event is over after the predefined period of time and in response returning the adaptation of the adaptive control filter to a normal rate.

4. The method of claim 1 wherein performing the ANC process comprises identifying a signal path between the speaker driver system and an error microphone that are at the user's ear.

5. The method of claim 4 wherein identifying the signal path comprises computing an adaptive signal path estimating filter that estimates a transfer function of the signal path, in accordance with an adaptive filter control algorithm.

6. The method of claim 5 further comprising slowing down or freezing adaptation of the adaptive signal path estimating filter, in response to the close talk event being declared.

7. A personal listening device comprising:

an earphone housing or a mobile phone handset housing containing a speaker driver system, a vibration sensor, a first acoustic microphone and a second acoustic microphone;

an active noise control (ANC) controller coupled to receive the signals from the first and second microphones that are used by an adaptive filter engine which updates an adaptive control filter that produces an anti-noise signal, the control filter being coupled to provide the anti-noise signal to the speaker driver system; and a detector that computes a statistic using an L2 norm of a cross-correlation vector between the vibration sensor signal and one of the signals from the first and second acoustic microphones, compares the statistic to a threshold, and declares a speech detected condition when the statistic is greater than the threshold, wherein the ANC controller responds to the speech detected condition by slowing down or freezing the updating of the adaptive control filter.

8. The device of claim 7 wherein the ANC controller further comprises an adaptive filter engine that updates a further adaptive filter that estimates a transfer function of a signal path between the speaker driver system and the first microphone.

9. The device of claim 8 wherein the ANC controller further responds to the speech detected condition by slowing down or freezing the updating of the further adaptive filter.

10. The device of claim 7 wherein the detector is to hold the declaration of the speech detected condition for a predefined period of time, even while not detecting speech when processing the vibration sensor signal and the one or more signals from the first and second microphones during the predefined period of time.

11. The device of claim 7 wherein the ANC controller returns to updating the adaptive control filter at a normal rate in response to the speech detected condition being over.

12. A personal listening device comprising:

a speaker driver system;

a vibration sensor;

first and second acoustic microphones;

means for containing the speaker driver system, the vibration sensor, the first acoustic microphone and the second acoustic microphone;

means for adapting a first programmable digital filter using the signals from the first and second microphones, wherein the first programmable digital filter produces an anti-noise signal and is coupled to provide the anti-noise signal to the speaker driver system; and means for processing the signal from the vibration sensor and one or both of the signals from the first and second acoustic microphones, to declare a speech detected condition and hold the speech detected condition for a predefined period of time, wherein the adapting means responds to the speech detected condition by slowing down or freezing its adaptation of the first programmable digital filter.

13. The device of claim 12 further comprising means for adapting a second programmable digital filter engine that estimates a transfer function of a signal path between the speaker driver system and the first microphone.

14. The device of claim 13 wherein the means for adapting the second filter responds to the speech detected condition by slowing down or freezing its adaptation of the second filter.

15. The device of claim 12 wherein the means for adapting the first filter resumes its adaptation of the first filter at a normal rate, in response to the speech detected condition being over after the predefined period of time.

16. A method for active noise control (ANC) in a personal listening device that is at a user's ear, comprising:

performing an adaptive active noise control (ANC) process in a personal listening audio device, wherein the personal listening audio device has an earphone housing or a mobile phone handset housing containing a speaker driver system and that is up against the user's ear, and wherein the ANC process uses an adaptive control filter to produce an anti-noise signal that is fed to the speaker driver system;

detecting a close talk event using signals from a vibration sensor and an acoustic microphone that are integrated in the earphone housing or mobile phone handset housing of the device, wherein the close talk event coincides with the user talking;

holding a declaration of the close talk event for a predefined period of time following the detection of the close talk event regardless of having detected during the hold interval that user speech has stopped; and slowing down or freezing adaptation of the adaptive control filter during the declaration of the close talk event.

17. The method of claim 16 further comprising ending the holding of the of the declaration of the close talk event after the predefined period of time, when no close talk event is detected using the signals from the vibration sensor and the acoustic microphone.

18. The method of claim 17 further comprising returning the adaptation of the adaptive control filter to a normal rate in response to the ending of the holding of the declaration of the close talk event.

19. The method of claim 16 wherein detecting the close talk event comprises:

computing a statistic using a cross correlation function between the signals from the vibration sensor and the acoustic microphone; and comparing the statistic to a threshold, and asserting the declaration of the close talk event when the statistic is greater than the threshold.

20. The method of claim 19 wherein computing the statistic comprises computing an L2 norm of a cross-correlation vector between the vibration sensor and microphone signals.

21. A personal listening device comprising:

an earphone housing or a mobile phone handset housing containing a speaker driver system, a vibration sensor, a first acoustic microphone and a second acoustic microphone;

an active noise control (ANC) controller coupled to receive the signals from the first and second microphones that are used by an adaptive filter engine which updates an adaptive control filter that produces an anti-noise signal, the control filter being coupled to provide the anti-noise signal to the speaker driver system; and a detector that processes the signal from the vibration sensor and one or both of the signals from the first and second acoustic microphones, to declare a speech detected condition, and to hold a declaration of the speech detected condition for a predefined period of time regardless of having detected during the hold interval that user speech has stopped, wherein the ANC controller responds to the declaration of the speech detected condition by slowing down or freezing the updating of the adaptive control filter during the holding of the declaration of the speech detected condition.

22. The device of claim 21 wherein the detector is further to end the declaration of the speech detected condition after the predefined period of time when no speech condition is detected using the signals from the vibration sensor and the first and second acoustic microphones.

23. The device of claim 22 wherein the ANC controller returns to updating the adaptive control filter at a normal rate in response to the end of the declaration of the speech detected condition.

24. The device of claim 21 wherein the detector is to compute a statistic using a cross correlation function between the vibration sensor signal and one of the signals from the first and second acoustic microphones, compare the statistic to a threshold, and declare the speech detected condition when the statistic is greater than the threshold.

25. The device of claim 24 wherein the detector is to compute the statistic by computing an L2 norm of a cross-correlation vector between the vibration sensor and one of the signals from the first and second acoustic microphones.

* * * * *